United States Patent [19]

Eto et al.

[11] 4,449,949

[45] May 22, 1984

[54] METHOD OF MANUFACTURING A FLAT-TYPE FLUORESCENT DISPLAY TUBE

[75] Inventors: Goro Eto; Atsushi Nishimuro; Noriyoshi Fukuda, all of Mobara, Japan

[73] Assignee: Futaba Denshi Kogyo K.K., Mobara, Japan

[21] Appl. No.: 422,085

[22] Filed: Sep. 23, 1982

Related U.S. Application Data

[62] Division of Ser. No. 149,748, May 14, 1980, abandoned.

[30] Foreign Application Priority Data

May 16, 1979 [JP] Japan ..... 54-59089

[51] Int. Cl.[3] ..... H01J 9/2

[52] U.S. Cl. ..... 445/24; 445/58; 427/110

[58] Field of Search ..... 445/24, 25, 58; 65/60.5, 60.51; 427/110

[56] References Cited

U.S. PATENT DOCUMENTS

| | | | |
|---|---|---|---|
| 3,979,623 | 9/1976 | Yanagisawa | 445/58 |
| 4,004,186 | 1/1977 | Bylander | 315/167 |
| 4,045,703 | 8/1977 | Mori et al. | 313/497 |
| 4,122,376 | 10/1978 | Mera et al. | 315/167 |
| 4,132,920 | 1/1979 | Kobayakawa | 445/24 |

FOREIGN PATENT DOCUMENTS

| | | | |
|---|---|---|---|
| 49-15421 | 4/1974 | Japan | 60/60.51 |
| 54-73555 | 6/1979 | Japan | 445/25 |

*Primary Examiner*—Kenneth J. Ramsey

*Attorney, Agent, or Firm*—Oblon, Fisher, Spivak, McClelland & Maier

[57] ABSTRACT

An flat envelope for hermetically containing various functional elements of an fluorescent display tube is disclosed. The envelope includes a base plate and a transparent front plate mounted on a front surface of the base plate to form a chamber with the base plate which contains a plurality of the indicator elements. The front plate comprises an upper glass plate, pillared glass strip side wall plates which are bonded to the inside periphery of the upper plate and a transparent electrically-conductive film for shielding static electricity deposited on the inner surface of the upper plate except the peripheral sealing portion of the upper plate and the peripheral side wall of the side wall plates.

3 Claims, 11 Drawing Figures

METHOD OF MANUFACTURING A FLAT-TYPE FLUORESCENT DISPLAY TUBE

This is a division of application Ser. No. 149,748, filed May 14, 1980, now abandoned.

BACKGROUND OF THE INVENTION

1. Field of the Invention

This invention relates generally to a plane type fluorescent display tube and a method of manufacturing the same, and more particularly to improvements in a front glass plate of the fluorescent display tube on the inner surface of which a transparent electrically-conductive layer is deposited.

2. Description of the Prior Art

A fluorescent display tube provided with a filamentary cathode (hereinafter referred to as a filament) and a plurality of anodes having a phosphor layer applied thereon is known. Electrons emitted from the filament are directed to selectively impinge upon the anodes to excite them for emitting light, thereby effecting a luminous display. The fluorescent display tube can be driven at a relatively low voltage and is low in power consumption, and yet very bright and legible display is obtained. Accordingly, it is widely used as a display device in various electronic instruments.

The fluorescent display tube includes an envelope or enclosure which is hermetically sealed and accommodates at least the filament for emitting the electrons, display portions for effecting the luminous display upon impingement of the electrons, and the like in such a manner that the luminous display can be observed from the outside by energizing and driving these functional elements by an external source. The envelope which has now been widely used in the fluorescent display tube is thin and flat in shape so that it may be applicable to thin and compact electronic appliances.

One of the conventional flat-type fluorescent display tubes is shown in FIGS. 1 and 2. The method of manufacturing the display tube shown in FIGS. 1 and 2 comprises the steps of preparing a substrate 1 made of an electrically-insulating material, such as, for example, a glass plate, depositing an electrically-conductive wiring layer 2, an electrically, insulating layer 3 and an electrically-conductive anode layer 5 deposited a phosphor layer 4 thereon on the surface of the substrate 1 in a laminated manner one another, thereby forming a display portion 6, arranging a control electrode 7 and filament 8 above the display portion 6, covering these functional elements with a front plate 9 which is formed into a flat-bottomed boat shape having a transparent viewing window at a portion opposite to the display portion 6 and having the entire inner surface coated with a transparent electrically-conductive layer 13 made of, such as, for example, tin oxide thin film, hermetically sealing peripheral portions 1*a* and 9*a* of the substrate 1 and the front plate 9 using a sealing medium 11 such as frit glass interposing terminal lead-in wires 10 for connecting the various functional elements of the display tube to an external circuit therebetween, and evacuating the inside of the envelope 12 thus formed to provide a vacuum casing. The transparent conductive layer 13 deposited on the entire inner surface of the front plate 9 is connected to a cathode circuit of the filament 8 to prevent the inner wall of the front plate 9 from being electrically charged and also to shield the tube from external electrostatic fields.

The front plate 9 of the envelope 12 which has been generally used heretofore is manufactured by heating a glass plate of predetermined dimension at a high temperature of approximately above 700° C., thereby softening the glass plate, and then the high temperature and softened glass plate is subjected to a press forming operation. Therefore, in the conventional front plate, unsightly distortion resulting from uneven surfaces of the press molds is liable to be appeared on the upper viewing window of the front plate. In addition, because of existence of the bent portion around the periphery of the front plate, shrinkage due to the heating and cooling the front plate at the time of the molding is apt to be created, which causes a crack on the front plate in some instance. Also, the cost of the front plate becomes high, because the molds must be made of a special heat resisting material, such as, for example, graphite which is durable at the high temperature press work operation but relatively short in life. Furthermore, foreign materials on the mold surface tend to unremovably adhere to the sealing surface of the peripheral edge 9*a*, because the peripheral edge 9*a* is firmly clamped by the molds when the front plate is subjected to the high temperature press work. The adhesion of the foreign materials to the sealing surface of the peripheral edge 9*a* causes slow leak, minor crack and other defects after sealing the envelope.

In the conventional front plate 9 explained hereinabove, the transparent conductive film 13 is deposited on the entire inner surface of the front plate 9 extending to the sealing surface of the peripheral edge 9*a* which is bonded to the glass base plate 1 and is in close proximity of the terminal lead-in wires 10 after assembling the envelope 12 as shown in FIG. 2. Therefore, the envelope is liable to be shortcircuited. In addition, there is the possibility of the slow leak or malseal resulting from the inferior bond between the transparent conductive film 13*a* and the sealing medium 11 around the peripheral edge 9*a* of the front plate 9 when the envelope is assembled.

Furthermore, in the conventional flat-bottomed boat shape front plate 9 which is provided with a flange around the peripheral edge 9*a* thereof for the sealing, the viewing window 15 opposite to the display portion 6 is smaller in comparison with the entire dimension of the front plate 9 and viewing angle of the display portion 6 is limited.

Reference will now be made to another conventional flat-type fluorescent display tube which is different from that explained hereinabove with reference to FIGS. 3, 4, 5 and 6. In these drawings, like reference characters designate corresponding parts shown in FIGS. 1 and 2.

The fluorescent display tube shown in FIGS. 3–6 comprises a base plate 1 made of an electrically-insulating material such as a glass plate similar to the base plate explained in the conventional fluorescent display tube shown in FIGS. 1 and 2, a display portion 6 deposited on the surface of the base plate 1 which is formed of an electrically-conductive wiring layer, an electrically-insulating layer and an electrically-conductive anode layer on the surface of which is coated with a phosphor layer, and a control electrode 7 and a filament 8 arranged above the display portion 6. A front plate 16 covering these functional elements consists of an upper face plate 17 which is a transparent flat glass plate having a predetermined dimension and side wall plate 18, and the upper face plate 17 and the side wall plate 18 are bonded together using a sealing medium 11 such as frit glass in a box-lid shape. The front plate 16 is hermetically sealed to the base plate 1 at the peripheral edges thereof using the sealing medium 11 such as frit glass interposing terminal lead-in wires 10 therebetween. The hollow casing thus formed is evacuated to provide a flat and square envelope 19. The side wall plate 18 for forming the front plate is usually made of a hollow ceramic or glass frame or pillared glass strips assembled in a shape of hollow frame using the sealing medium.

Referring to an inner surface of the front plate 16 and a sealing portion of the envelope 19 explained hereinabove, in the envelope shown in FIG. 5, a transparent electrically-conductive film 20*a* is deposited on the entire inner surface of the front plate 16*a* which is formed of the upper face plate 17*a* and the side wall plate 18*a* bonded at the periphery of the upper face plate 17*a*, and the front plate 16*a* is sealed to the base plate 1 at the peripheral edges thereof by means of the side wall plate 18*a* interposing the terminal lead-in wires 10 between the marginal edges of the side wall plate 18*a* and the base plate 1. In the envelope shown in FIG. 6, an upper face plate 17*b* made of a flat glass plate having a predetermined dimension is pre-coated with a transparent electrically-conductive film 20*b* on the entire under surface thereof, and a side wall plate 18*b* is bonded to the periphery of the upper face plate 17 coated with the transparent conductive film, thereby to form the front plate 16*b*. The front plate 16*b* thus formed is bonded to the periphery of the base plate 1 interposing the terminal lead-in wires 10 therebetween.

The upper viewing surface of the enclosures 19 shown in FIGS. 5 and 6 is perfectly flat without any curvature different from that shown in FIG. 1. Therefore, the display portion 6 is easy to observe and the viewing angle of the display portion 6 on the base plate 1 is wider. Furthermore, the enclosure is easy to produce at the relatively low cost, because the heat forming processing which uses the high temperature press molds is not required to form the front plate 16 (16*a* and 16*b*).

However, the envelope shown in FIG. 5 is disadvantageous in that the transparent conductive film 20*a* and the terminal lead-in wires are liable to be shortcircuited, because the transparent conductive film 20*a* deposited on the inner surface and the marginal edges of the side wall plate 18*a* is in close proximity of the terminal lead-in wires 10 with the thin sealing medium layer 11*a* therebetween. In addition, because of existence of the transparent conductive layer 20*a* on the sealing surface of the envelope, there is the possibility of causing slow leak or malseal which develops into minor cracks at the sealing portion. In the same way, the envelope shown in FIG. 6 is disadvantageous in that slow leak or malseal tends to be created at the sealing portion of the upper face plate 17*b* and the side wall plate 18*b*, because the transparent conductive film 20*b* deposited on the entire under surface of the upper face plate 17 extends to the sealing portion of the upper face plate 17*b* and the side wall plate 18*b*.

In the conventional process for coating the inner surface of the front plate with the transparent conductive film such as tin oxide, an independent coating process is required, which makes the manufacturing process of the fluorescent tube extremely complicate.

SUMMARY OF THE INVENTION

Therefore, the present invention contemplates to eliminate the above-mentioned disadvantages of the conventional indicator tube and to provide a new and novel flat-type fluorescent display tube and a method of manufacturing the same.

It is an object of the present invention to provide a flat-type fluorescent display tube which eliminates complicated and independent transparent electrically-conductive film forming processes on a surface of upper viewing window which are required in the conventional process, thereby to simplify the manufacturing process and to produce high quality product on a mass production basis at low cost.

It is another object of the present invention to provide a flat-type fluorescent display tube which is extremely reliable and stable in the operation without the possibility of slow leak, malseal, creation of minor cracks or shortcircuit.

It is still another object of the present invention is to provide a flat-type fluorescent display tube which permits to observe indicator elements within a casing from angles of wide range without accompanying any viewing distortion of the indicator elements.

It is a further object of the present invention to provide a flat-type fluorescent display tube which is capable of reducing size of a casing in comparison with that of indicator elements so as to be suitable for use in small-sized electronic appliances and easy to observe the indicator elements.

It is a still further object of the present invention to provide an improved method of manufacturing a front plate used in a casing of flat-type fluorescent display tube which is free from slow leak, malseal, or short-circuit when it is assembled to form a vacuum envelope.

The foregoing and other objects are attained in accordance with one aspect of the present invention through the provision of a flat-type fluorescent display tube which comprises a base plate and a front plate to be hermetically sealed to the base plate at the periphery thereof to form an envelope. The envelope accomodates a filamentous cathode which emits electrons, display portions coated with phosphor layers for effecting a luminous display upon impingement of the electrons, and terminal lead-in wires connected to each of electrodes within the envelope and led out in an air tight manner through the sealing portion of the envelope for connecting to an external voltage source to allow the voltage to one or more of the electrodes as desired. The front plate is made of a flat transparent glass upper plate and pillared glass strip side wall plates which are bonded to the periphery of the upper plate in a shape of box lid, and a transparent electrically-conductive film for shielding static electricity is deposited on the inner surface of the upper plate except the peripheral sealing portion thereof.

According to other aspect of the present invention, there is provided a method of manufacturing a front plate used in an envelope of flat-type fluorescent display tube. The method of the present invention comprises the steps of preparing a flat glass upper plate, applying a fusion bonding glass paste formed essentially of a low-melting frit glass to the inside edge portion of the upper plate by a screen printing technique, firing the upper plate to which the fusion bonding glass paste is applied, spraying a mist of transparent electrically-conductive film forming liquid, such as, for example, liquid of tin halide, which is generally referred to as NESA (Trademark for coated glass and related goods) liquid, on the inside surface of the upper plate at the time of the firing, thereby to deposite the transparent conductive film made of tin oxide thin film on the inside surface of the upper plate simultaneously with the firing of the fusion bonding glass paste, and bonding side wall plates consisting of pillared glass blocks to the periphery of the upper plate using a sealing medium formed essentially of a low-melting frit glass, thereby to form a box lid shaped front plate consisting of the flat upper plate and the pillared side wall plates, the inside surface of the upper plate except the peripheral sealing portion thereof being coated with the transparent conductive film.

BRIEF DESCRIPTION OF THE DRAWINGS

Other objects, features and advantages of the present invention will be more apparent from the following description with reference to the accompanying drawings in which like reference characters designate corresponding parts throughout the views in which.

DETAILED DESCRIPTION OF THE PREFERRED EMBODIMENTS

Figure 1:
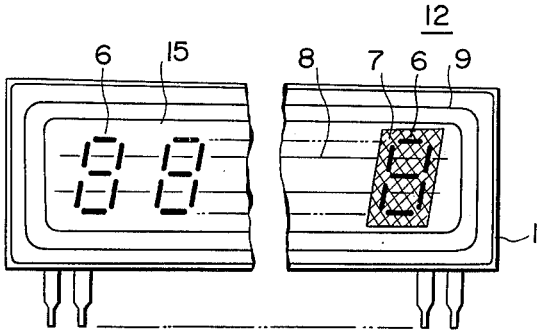
FIG.1 (PRIOR ART)
FIG. 1 is a partially cutaway plan view of the essential part of a conventional flat-type fluorescent display tube, showing an example thereof.
Figure 2:
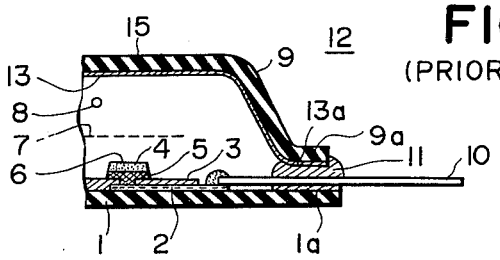
FIG.2 (PRIOR ART)
FIG. 2 is a partial sectional view of the conventional flat-type fluorescent display tube shown in FIG. 1.
Figure 3:
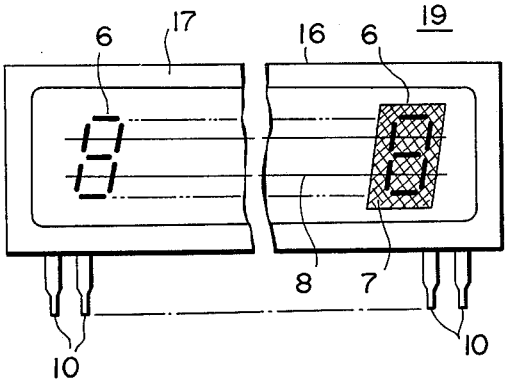
FIG.3 (PRIOR ART)
FIG. 3 is a partially cutaway plan view of the essential part of a conventional flat-type fluorescent display tube, showing another example.
Figure 4:
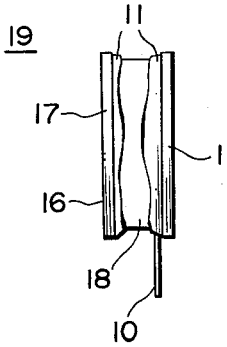
FIG.4 (PRIOR ART)
FIG. 4 is an end view of FIG. 3.
Figure 5:
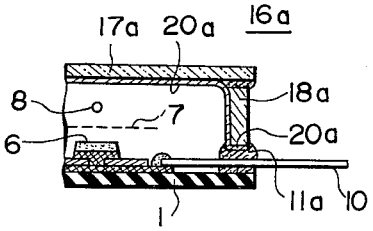
FIG.5 (PRIOR ART)
FIG. 5 is a partial sectional view of a conventional flat-type fluorescent display tube of a type shown in FIG. 3.
Figure 6:
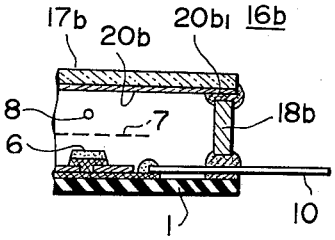
FIG.6 (PRIOR ART)
FIG. 6 is a partial sectional view of a conventional flat-type fluorescent display tube of another type shown in FIG. 3.
Figure 7:
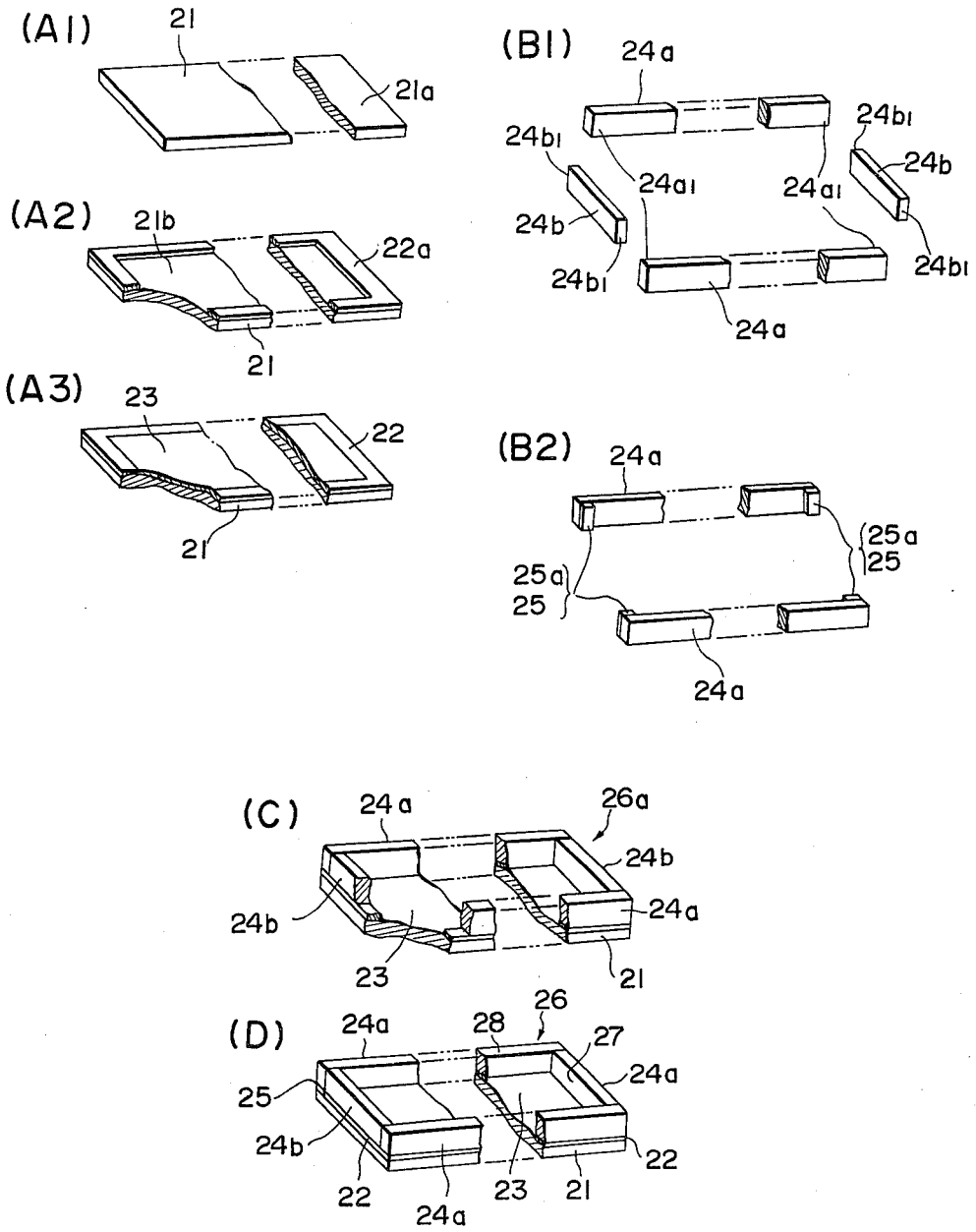
FIG. 7 shows sequential steps of manufacturing a front plate used in an envelope of flat-type fluorescent display tube according to an embodiment of the present invention.

Referring now to a method of manufacturing a flat-type fluorescent display tube according to a first embodiment of the present invention shown in FIG. 7, and more particularly to a front plate used in an envelope of the flat-type fluorescent display tube of the present invention, the front plate is manufactured by the sequential steps schematically illustrated in (A1), (A2), (A3), (B1), (B2), (C) and (D) of FIG. 7.

First, a flat upper plate 21 is prepared by cutting a transparent glass plate into a predetermined dimension as shown in FIG. 7 (A1). Then, a fusion bonding glass paste 22*a* is applied to the peripheral edges 21*a* of one side surface of the upper plate 21 which is to be directed to the inside of the front plate by a screen printing technique as shown in FIG. 7 (A2). The fusion bonding glass paste 22*a* used in the screen printing process consists essentially of mixture of noncrystalline low-melting frit glass, a binder such as nitro-cellulose and organic solvent for the binder which are kneaded together so as to have appropriate tackiness at least at a normal temperature and to be easily printed.

The upper plate 21 having deposited the fusion bonding glass paste 22*a* thereon is fired in a furnace at a temperature within a range of approximately 450°-650° C. in which the low-melting frit glass in the fusion bonding glass paste 22*a* is fused to be bonded to the upper plate 21. At the same time, a mist of NESA (Trademark for coated glass and related goods) liquid is sprayed on the inside surface of the upper plate 21, namely the peripheral edges 21*a* on which is deposited the fusion bonding glass paste 22*a* and the surface 21*b* surrounded by the peripheral edges 21*a*. Then, the upper plate 21 which is underwent by such surface treatments that the fusion glass 22 is deposited around the peripheral edges 21*a* of the inside surfaces of the upper plate 21 and the surface 21*b* surrounded by the peripheral edges 21*a* is coated with the transparent conductive film 23 is obtained as shown in FIG. 7 (A3). When effecting the surface treatment, the mist of the NESA (Trademark for coated glass and related goods) liquid is sprayed as a matter of course on the fusion bonding glass paste 22*a* around the peripheral edges 21 as well, however, the deposition of the NESA (Trademark for coated glass and related goods) film on the fusion glass is prevented due to dispersion and combustion of the binder and the organic solvent contained in the fusion bonding glass paste 22*a* when firing the glass paste 22*a*. Even though a part of the NESA (Trademark for coated glass and related goods) film is deposited on the fusion glass 22, it is diffused into the fusion glass 22. Therefore, it does not affect quality of the fusion glass and the excellent fusion glass 22 can be deposited on the upper plate 21.

On the other hand, a plurality of side wall plates made of pillared glass blocks 24*a* and 24*b* for constituting the side walls of the front plate to be arranged in face-to-face relation in the front plate are prepared by cutting a flat glass plate into a predetermined dimension as shown in FIG. 7(B1). Then, a fusion bonding glass paste 25*a* is applied to one of the connecting surfaces, for example, the end surfaces $24a_1$ of the side wall plates 24*a*, of the side wall plates 24*a* and 24*b* by a screen printing technique as shown in FIG. 7(B2). The fusion bonding glass paste 25*a* used in this process may be equivalent to that used in the screen printing process of the upper plate, and consists essentially of the mixture of non-crystalline low-melting frit glass, the binder such as nitrocellulose and organic solvent for the binder which are kneaded together so as to have appropriate tackiness at least at a normal temperature and to be easily printed.

The side wall plates 24*a* having deposited the fusion bonding glass paste 25*a* on the inside edges thereof are fired in a furnace at a temperature within a range of approximately 450°-650° C. in which the low-melting frit glass in the fusion bonding glass paste 25*a* is fused to be bonded to the side wall plates to form beads of the fusion glass 25.

In the next step, a front plate assembly 26*a* is fabricated as shown in FIG. 7(C) by mounting the vertical and horizontal side wall plates 24a and 24b which are formed by the steps shown in FIG. 7 (B1) and (B2) and having deposited the fusion glass 25 at least on either the connecting surfaces $24a_1$ or $24b_1$ on the peripheral edges of the upper plate 21 shown in FIG. 7(A3) on which the fusion glass is deposited. The fabrication of the front plate assembly 26a is effected by using an appropriate jig (not shown) which guides the various components of the front plate assembly 26a into the predetermined mounting positions and lightly presses the connecting portion of the front plate assembly 26a by a spring or weight.

Then, the front plate assembly 26a prefabricated on the jig is fired in a furnace at a fusion bonding temperature of the low-melting frit glass in the fusion glass beads 22 and 25. In the firing process, the upper plate 21 and the side wall 24a and 24b are airtightly bonded together by the re-fusion of the low-melting frit glass in the fusion glass beads 22 and 25, thereby to form a box-lid shaped front plate 26 as shown in FIG. 7(D). In this instance the binder and the organic solvent contained in the fusion glass beads 22 and 25 prior to the firing are completely dispersed and burned at the fusion bonding temperature of the low-melting frit glass in the two firing processes explained hereinabove.

In the method of manufacturing the front plate according to the present invention, the transparent conductive film 23 applied to the inside surface of the front plate 26 is only deposited on the inside surface of the upper plate 21 except the peripheral sealing portion thereof, and the inner surfaces 27 of the side wall plates 24a and 24b and the marginal end surfaces 28 are free from the transparent conductive film 23.

Figure 8:
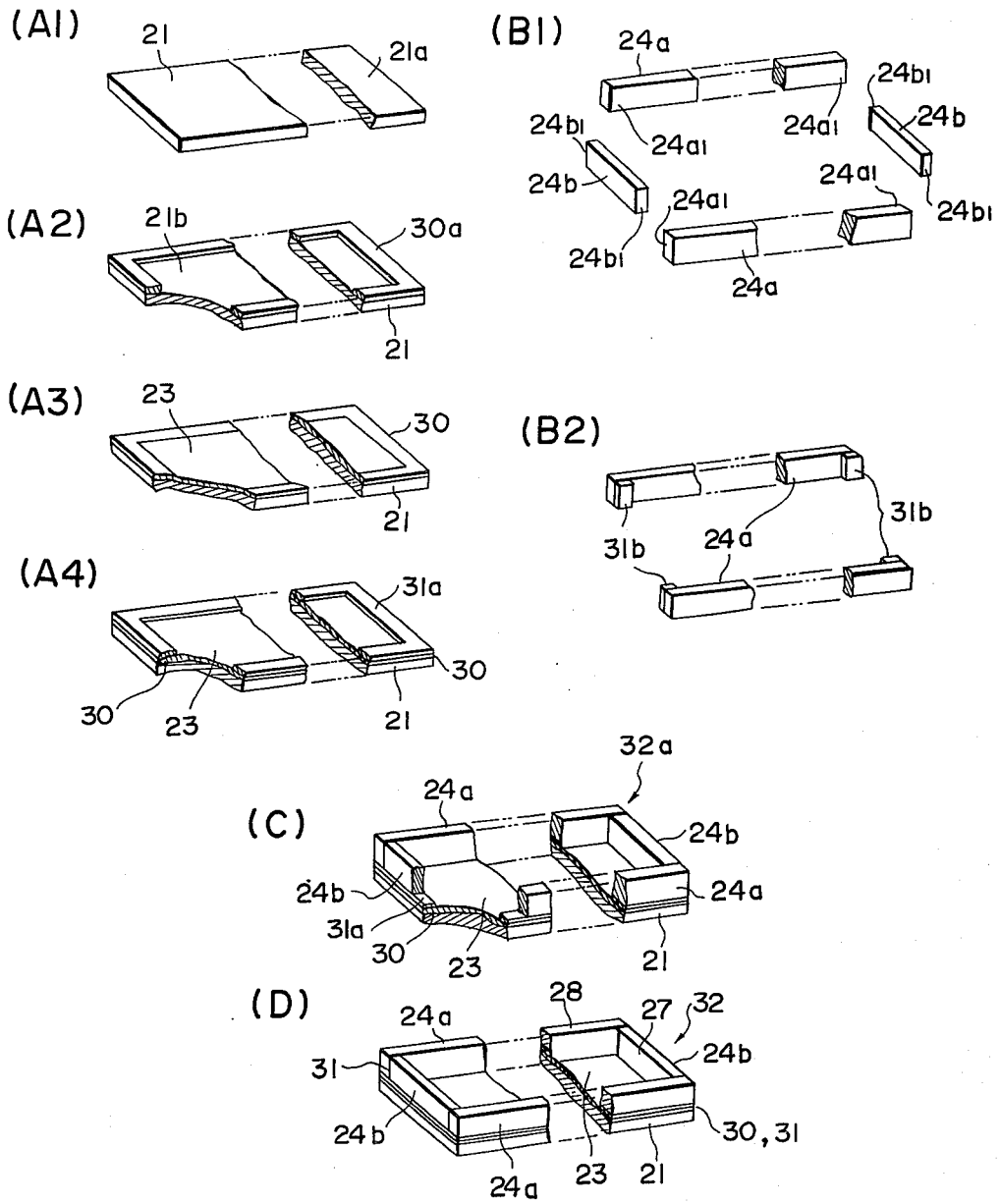
FIG. 8 shows sequential steps of manufacturing a front plate used in an envelope of flat-type fluorescent display tube according to another embodiment of the present invention.

Referring now to a method of manufacturing a flat-type fluorescent display tube according to a second embodiment of the present invention shown in FIG. 8, and more particularly to a front plate used in an envelope of the flat-type fluorescent display tube of the present invention, the front plate of this embodiment is manufactured by the sequential steps schematically illustrated in (A1), (A2), (A3), (A4), (B1), (B2), (C) and (D) of FIG. 8.

As a first step, a flat upper plate 21 is prepared by cutting a transparent glass plate into a predetermined dimension as shown in FIG. 8 (A1). Then, a fusion bonding glass paste 30a is primarily applied to the peripheral edges 21a of one side surface of the upper plate 21 which is to be directed to the inside of the front plate by a screen printing technique as shown in FIG. 8 (A2). The fusion bonding glass paste 30a used in the primary screen printing consists essentially of mixture of crystalliine low-melting frit glass, a binder such as nitrocellulose and organic solvent for the binder which are kneaded together so as to have appropriate tackiness at least at a normal temperature and to be easily printed.

The upper plate 21 having deposited the fusion bonding glass paste 22a thereon is fired in a furnace at a temperature within a range of approximately 450°-650° C. in which the low-melting frit glass in the fusion bonding glass paste 30a is fused to be bonded to the upper plate 21. At the same time, a mist of NESA (Trademark for coated glass and related goods) liquid is sprayed on the inside surface of the upper plate 21, namely the peripheral edges 21a on which is deposited the fusion bonding glass paste 30a and the surface 21b surrounded by the peripheral edges 21a. Then the upper plate 21 which is underwent by such surface treatments that the fusion glass 30 is deposited around the peripheral edges 21a of the inside surface of the upper plate 21 and the surface 21b surrounded by the peripheral edges 21a is coated with the transparent conductive film 23 is obtained as shown in FIG. 8 (A3). When effecting the surface treatment, the mist of the NESA liquid is sprayed as a matter of course on the fusion bonding glass paste 30a around the peripheral edges 21a as well, however, the deposition of the NESA film on the fusion glass is prevented due to dispersion and combustion of the binder and the organic solvent contained in the fusion bonding glass paste 30a when firing the glass paste 30a. Even though a part of the NESA film is deposited on the fusion glass 30, it is diffused into the fusion glass. Therefore, the quality of the fusion glass is not adversely affected by the NESA film and the excellent fusion glass 22 can be deposited on the upper plate 21. Then, the secondary fusion bonding glass paste 31a is applied onto the fusion glass 30 around the periphery of the upper plate 21 which is subjected to the foregoing surface treatment by a screen printing technique as shown in FIG. 8 (A4). The fusion bonding glass paste 31a used in the secondary glass paste printing process consists essentially of mixture of low-melting frit glass, a binder such as nitrocellulose and organic solvent for the binder which are kneaded together so as to have appropriate tackiness at least at a normal temperature and to be easily printed.

On the other hand, a plurality of side wall plates made of pillared glass blocks 24a and 24b for constituting the side walls of the front plate to be arranged in face-to-face relation in the front plate are prepared by cutting a flat glass plate into a predetermined dimension as shown in FIG. 7 (B1). Then, a fusion bonding glass paste 31a is applied at least to one of the connecting surfaces $24a_1$ of the side wall plates 24a of the side wall plates 24a and 24b by a screen printing technique as shown in FIG. 8 (B2). The fusion bonding glass paste 31b used in this process may be equivalent to that used in the secondary glass paste printing process of the upper plate and consists essentially of the mixture of low-melting frit glass, the binder such as nitrocellulose and organic solvent for the binder which are kneaded together so as to have appropriate tackiness at least at a normal temperature and to be easily printed.

In the next step, a front plate assembly 32a is fabricated as shown in FIG. 8 (C) by mounting the vertical and horizontal side wall plates 24a and 24b which are formed by the steps shown in FIG. 7 (B1) and (B2) and having deposited the fusion bonding glass paste at least on either the connecting surfaces $24a_1$ or $24b_1$ on the peripheral edges of the upper plate 21 shown in FIG. 8 (A4) to which the fusion bonding glass paste according to the secondary printing process is applied, while the fusion bonding glass paste is still sticky and is not dried. Then, the side wall plates 24a and 24b is held on the upper plate 21 by the adhesive force of the fusion bonding glass paste applied to the connecting portion of the side wall plates 24a and 24b and the upper plate 21. In order to correctly arrange the side wall plates 24a and 24b with respect to the upper plate 21, it is advantageous to use a jig which permits to dispose the side wall plates 24a and 24b so as to be correctly connected with each other and positioned with respect to the upper plate 21, and to press each of the connecting portions of the side wall plates and the upper plate by a spring or weight.

Then, the front plate assembly 32a is fired in a furnace at a fusion bonding temperature of the low-melting frit glass in the pastes 31*a* and 31*b*. When the jig is used, the front plate assembly 32*a* is fired together with the jig. In the firing process, the upper plate 21 and the side wall plates 24*a* and 24*b* are airtightly bonded together by the fusion of the low-melting frit glass in the fusion bonding glass paste, thereby to form a box-lid shaped front plate 32 as shown in FIG. 8 (D). In this instance, the binder and organic solvent contained in the fusion bonding glass paste 31 prior to the firing are completely dispersed and burned at the fusion bonding temperature of the low-melting frit glass.

In the method of manufacturing the front plate according to the second embodiment of the present invention, the transparent conductive film 23 applied to the inside surface of the front plate 32 is only deposited on the inside surface of the upper plate 21 except the peripheral sealing portion thereof in the same way as the first embodiment, and the inner surfaces 27 of the side wall plates 24*a* and 24*b* and the marginal end surfaces are free from the transparent conductive film 23.

In the embodiment explained hereinabove, the fusion bonding glass paste consisting essentially of the low-melting crystalline frit glass is used as the bonding paste to be primary applied to the peripheral surface 21*a* of the upper glass plate 21, however, it is to be understood that the paste is not limited to that explained in the foregoing embodiment but it may be formed essentially of the low-melting non-crystalline frit glass. In this instance, the bonding paste is selected from those which contain the low-melting frit glass having slightly higher melting point which does not melt at the temperature of the each of the firing processes after the primary paste 30*a* is fused to be bonded onto the upper plate 21 as an active component. It is also to be understood that the bonding pastes 31*a* and 31*b* to be applied to the fusion glass 30 deposited on the periphery of the upper plate 21 which is subjected to the surface treatment and at least one of the connecting surfaces of the side wall plates 24*a* and 24*b* may be of either crystalline or non-crystalline. However, when using the paste which contains the non-crystalline frit glass as an active component, it should be selected from those which contain the low-melting frit glass having slightly higher melting point which does not melt at the temperature of sealing the upper plate 21 to the base plate after the front plate 26 (32) is assembled by bonding the side wall plates 24*a* and 24*b* to the upper plate 21 together using the fusion bonding glass paste.

Reference will now be made to a flat-type fluorescent display tube according to the present invention which uses the front plate 26(32) manufactured by the method explained hereinabove in connection with FIGS. 9, 10 and 11.

Figure 9:
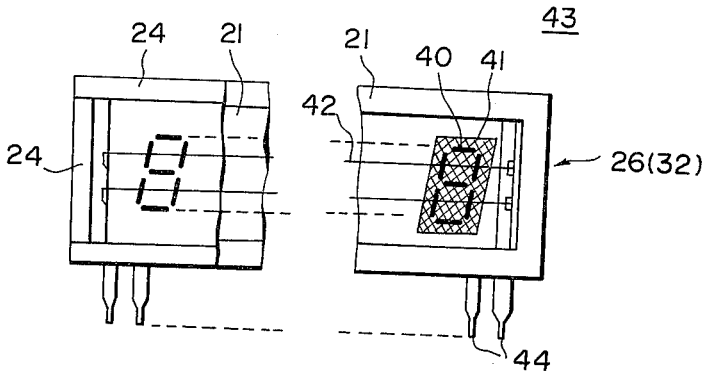
FIG. 9 is a partially cutaway plan view of the essential part of a flat-type fluorescent display tube according to an embodiment of the present invention.
Figure 10:
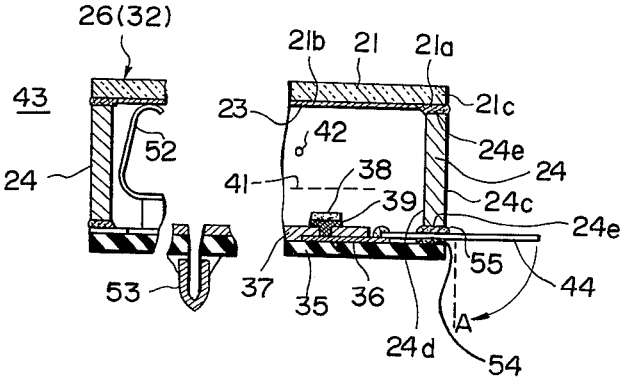
FIG. 10 is a partially broken away sectional view of the flat-type fluorescent display tube shown in FIG. 9.
Figure 11:
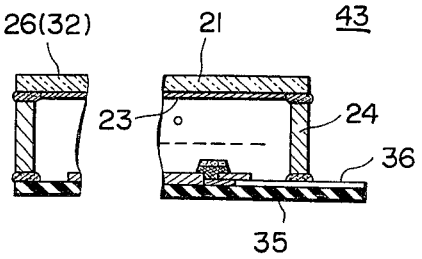
FIG. 11 is a partially broken away sectional view of a flat-type fluorescent display tube according to another embodiment of the present invention.

The flat-type fluorescent display tube shown in FIGS. 9 and 10 comprises a base plate 35 made of an insulating material, such as, for example, glass. On the surface of the base plate 35, there are provided wiring conductor films 36, an insulating film 37, and anode conductor film 39 having deposited thereon a phosphor layer 38 in a laminated manner one another, thereby to form display portions 40 for figures, numerals, symbols and the like. The fluorescent display tube further includes filamentous cathodes 42 disposed opposite to and above the display portions 40 and control electrodes 41 in a shape of mesh disposed opposite to the display portions 40 between the cathodes 42 and the display portions 40. These functional elements of the fluorescent display tube are airtightly covered by a front plate 26(32) bonded to the periphery of the base plate 35. The front plate 26(36) and the base plate 35 constitute an envelope 43, and terminal lead-in wires 44 for electrically connecting each of the electrodes within the envelope 43 to an external circuit are led out in an air-tight manner through a sealing portion 54 of the envelope 43.

At a suitable location of the base plate 35, there is provided an exhaust tube 53 for evacuating the envelope 43 after being assembled by the base plate 35 and the front plate 26(32). After the evacuation of the envelope 43 using the exhaust tube 53, the exhaust tube 53 is hermetically sealed, and the inside of the envelope 43 is maintained in a high vacuum atomosphere by the evacuation using the exhaust tube 53 and provision of a getter (not shown) within the envelope 43 so that it may be applicable to the fluorescent display tube.

The front plate 26(32) used in the fluorescent display tube according to the present invention consists of an upper plate 21 made of a transparent flat glass plate and side wall plates 24 made of pillared glass blocks which are bonded to the periphery of the upper plate 21 using, for instance, a sealing medium containing low-melting frit glass as an active component. As shown in FIG. 10, the end surfaces 21*c* around the upper plate 21 lie in substantially the same plane as the outer peripheral walls 24*c* of the side wall plates 24, and the resulting configuration of the upper plate 21 is a box-lid shape.

The shape and dimension of the base plate 35 to which the front plate 26(32) is hermetically sealed are analogous to those formed by sealing surfaces of the side wall plates 24 of the front plate 26(32). Accordingly, the envelope 43 formed by sealing the front plate 25(32) to the base plate 35 is a flat hexahedron box shape, if protrusions such as the terminal lead-in wires 44 and the exhaust tube 53 are not taken into consideration. The terminal lead-in wires 44 are led out through a side wall surface 55 of the substantially flat sealing portion 54 of the base plate 35 and the side wall plates 24. Because of this structure, the envelope 43 can be miniaturized as small as possible with respect to the dimension of the display portion 40. In addition, the sealing medium can be protected against cracks which may be caused by an external force when the terminal lead-in wires 44 are bent at the root thereof at the sealing portion 54 in the direction of the arrow A as shown by the dotted line in FIG. 10 for connecting the external circuit. Therefore, the handling and processing of the display tube can be simplified.

A transparent electrically-conductive film 23 deposited on the inner surface of the front plate 26(32) which is made of tin oxide and is generally referred to as a nesa film is only deposited on the inner surface 21*b* of the upper plate 21 except an inner surface 24*d* of the side wall plates 24, and a sealing surface 21*a* around the periphery of the upper plate 21 and a sealing surface of the side wall plates 24 are free from the transparent conductive film. The transparent conductive film 23 deposited on the inner surface of the upper plate 21 is contacted to a spring strip 52 made of an electrically-conductive material which is connected to the filament holding or independent terminal lead-in wire 44 mounted on the base plate 35 directly or by means of a metallic part so that the transparent conductive film 23 may be electrically connected to an cathode circuit of the filament 42 in order to prevent the inner surface of the front plate 26(32) opposite to the display portions 40 from being electrically charged and to shield the fluorescent display tube from external electrostatic fields for obtaining clear luminous display which is free from uneven luminance, frickering or the like in the display portions 40.

In the flat-type fluorescent display tube according to the present invention explained hereinabove, the display portions made of the anode conductive layers having deposited thereon the phosphor layer are shown as including a plurality of the display portions arranged in a row each consists of segmented anodes which delineate the digit "8". However, it is to be understood that the shape of the display portions is not limited to the particular shape illustrated in the foregoing embodiment, but may be in any optional shape, such as, for example, letter, figure, pattern and the like. Furthermore, the anodes in the display portions may be arranged in a matrix form, linear, curved line, or the combination thereof.

In the embodiment of the present invention, the terminal lead-in wires 44 are led out of the envelope through the sealing portion between the base plate 35 and the front plate 26(32). However, the wiring conductor film 36 deposited on the base plate 35 may be extended to the outside of the envelope 43 as shown in FIG. 11 to be connected to external connecting terminals.

Obviously, numerous modifications and variations of the present invention are possible in light of the above teachings. It is to be understood therefore that within the scope of the appended claims, the invention may be practiced otherwise than as specifically described herein.

What is claimed as new and desired to be secured by Letters Patent of the United States is:

1. A method of manufacturing a front plate used in an envelope of flat-type fluorescent display tube comprising the steps of:

preparing a flat glass upper plate, applying a fusion bonding glass paste formed essentially of a low-melting frit glass to inside edge portions of said upper plate by a screen printing technique, firing said upper plate to which the fusion bonding glass paste is applied, spraying a mist of transparent electrically-conductive film forming liquid on the inside surface of said upper plate at the time of the firing, thereby to deposite a transparent conductive film on the inside surface of said upper plate simultaneously with the firing of the fusion bonding glass paste, and bonding side wall plates consisting of pillared glass blocks to the periphery of said upper plate using a sealing medium formed essentially of a low-melting frit glass, therby to form a box lid shaped front plate consisting of said flat upper plate and the pillared side wall plates, with only the inside surface of the upper plate of said box lid shaped front plate being coated with the transparent conductive film.

2. A method of manufacturing a front plate used in an envelope of flat-type fluorescent display tube comprising the steps of:

preparing a flat glass upper plate;

applying a first fusion bonding glass paste formed essentially of a low-melting frit glass to inside edge portions of said upper plate by a screen printing technique, firing said upper plate to which the fusion bonding glass paste is applied, thereby to deposite a fusion bonded glass bead around the periphery of the inside edge portions of said upper plate, spraying a mist of transparent electrically-conductive film forming liquid on the inside surface of said upper plate at the time of the firing, thereby to deposite the transparent conductive film on the inside surface of said upper plate simultaneously with the firing of the fusion bonding glass paste, applying a second fusion bonding glass paste formed essentially of a low-melting frit glass to the glass bead around the periphery of the inside edge portions of said upper plate, and bonding side wall plates consisting of pillared glass blocks to the periphery of said upper plate using a sealing medium formed essentially of a low-melting frit glass, thereby to form a box lid shaped front plate consisting of the flat upper plate and said pillared side wall plates, with only the inside surface of said upper plate of said box lid shaped front plate being coated with said transparent conductive film.

3. A method of manufacturing a front plate used in an envelope of flat-type fluorescent display tube as in claims 1 or 2, wherein the transparent electrically-conductive film forming liquid is made of tin halide liquid.

* * * * *